US005567170A

United States Patent [19]

Kroeber

[11] Patent Number: 5,567,170

[45] Date of Patent: Oct. 22, 1996

[54] PLUG-IN POTHEAD

[75] Inventor: Richard B. Kroeber, Bartlesville, Okla.

[73] Assignee: Camco International Inc., Houston, Tex.

[21] Appl. No.: 350,794

[22] Filed: Dec. 7, 1994

[51] Int. Cl.[6] ..... H01R 13/53

[52] U.S. Cl. ..... 439/186; 439/272; 439/604

[58] Field of Search ..... 439/271, 272, 439/276, 181, 186, 604, 60, 190, 191, 192; 174/65 R; 310/87

[56] References Cited

U.S. PATENT DOCUMENTS

| | | | |
|---|---|---|---|
| 4,128,735 | 12/1978 | Zehren | 174/65 R |
| 4,295,701 | 10/1981 | Gunn | 439/271 |
| 4,583,804 | 4/1986 | Thompson | 439/60 M |
| 4,679,875 | 7/1987 | Ramsey | 439/604 |
| 5,113,101 | 5/1992 | Liu et al. | 310/87 |

*Primary Examiner*—P. Austin Bradley
*Assistant Examiner*—Yong Kim

[57] ABSTRACT

A plug-in electrical connector for use with an electrical submergible pumping system comprises a pothead having a first electrical connector member surrounded by a sleeve of insulative material extending from the pothead, and a terminal block with a recess therein adapted to receive thereinto the sleeve on the pothead and with a second electrical connector member set within the recess. The sleeve and the recess configured and sized to form a circuitous arc path, and the second electrical connector member is adapted to form an electrical connection with the first electrical connector member. A fluidic seal is included at the interface of the pothead and the terminal block. The circuitous arc path prevents shorting out by greatly increasing the distance shorting material, such as water, must travel from one phase to another phase or to ground.

15 Claims, 3 Drawing Sheets

PLUG-IN POTHEAD

BACKGROUND OF THE INVENTION

1. Field of the Invention

The present invention relates to an electrical connector for use within an electric submergible pumping system and, more particularly, to a plug-in pothead used to connect an electric motor within the electric submergible pumping system to an electrical power source.

2. Description of Related Art

In order to connect an electric submergible motor to an electrical power source there are currently two types of pothead connections. The first connection involves wrapping insulative tape around each electrical terminal in the pothead to prevent electrical contact from occurring from phase to phase and from phase to ground, or commonly called "shorting out". While the tape-type pothead connection has proven to be extremely durable with a long field life, the time it takes to make this connection and the relatively high level of skill involved in making such a connection are costly disadvantages. The second connection uses a pothead with pin electrical connectors being plugged into cylinder electric connectors in a terminal block mounted in the electric motor. The advantage of this plug-in type connection over the tapped connection are the saving in time and the relatively low level of skill required.

Plug-in type connections have proven to be much less durable in field use because fluid leakage occurs within the pothead and the terminal block to cause shorting out. One plug-in type pothead that has tried to solve this problem is shown in U.S. Pat. No. 5,113,101, wherein motor lead wires within the terminal block include insulative sheaths, and a gasket is placed between the pothead and the terminal block. While this plug-in pothead reduces the likely-hood of shorting out, relatively short electrical leakage paths still exist that will cause shorting out at the relatively high voltages commonly used within many installations of electric submergible pumping systems. In addition, during installation of the terminal block a pin must be inserted to radially and longitudinally align and secure the terminal block within the motor head. The forming of the hole in the motor head or receipt of the pin, as well as the installation of the pin requires additional time and cost that need to be eliminated to reduce the cost of the pothead.

There is a need for a plug-in type pothead that can be easily installed without the need for costly machining steps, and more importantly, there is a need for a plug-in type pothead that will not short out within a wellbore environment at relatively high voltages.

SUMMARY OF THE INVENTION

The present invention has been contemplated to overcome the foregoing deficiencies and meet the above described needs. Specifically, the present invention is a plug-in electrical connector for use with an electrical submergible pumping system comprises a pothead having a first electrical connector member surrounded by a sleeve of insulative material extending from the pothead, and a terminal block with a recess therein adapted to receive thereinto the sleeve on the pothead and with a second electrical connector member set within the recess. The sleeve and the recess configured and sized to form a circuitous arc path, and the second electrical connector member is adapted to form an electrical connection with the first electrical connector member. A fluidic seal is included at the interface of the pothead and the terminal block.

The circuitous arc path prevents shorting out by greatly increasing the distance shorting material, such as water, must travel from one phase to another phase or to ground. In addition, the terminal block includes snap-in type installation connectors that interact with a simple groove in the motor head to quickly and inexpensively radially and longitudinally align and secure the terminal block within the motor head.

DETAILED DESCRIPTION OF THE PREFERRED EMBODIMENTS

As has been briefly described above, the present invention is a plug-in electrical connector for use with an electrical submergible pumping system comprises a pothead having a first electrical connector member surrounded by a sleeve of insulative material extending from the pothead, and a terminal block with a recess therein adapted to receive thereinto the sleeve on the pothead and with a second electrical connector member set within the recess. The sleeve and the recess configured and sized to form a circuitous arc path, and the second electrical connector member is adapted to form an electrical connection with the first electrical connector member. A fluidic seal is included at the interface of the pothead and the terminal block. The circuitous arc path prevents shorting out by greatly increasing the distance shorting material, such as water, must travel from one phase to another phase or to ground.

Figure 1:
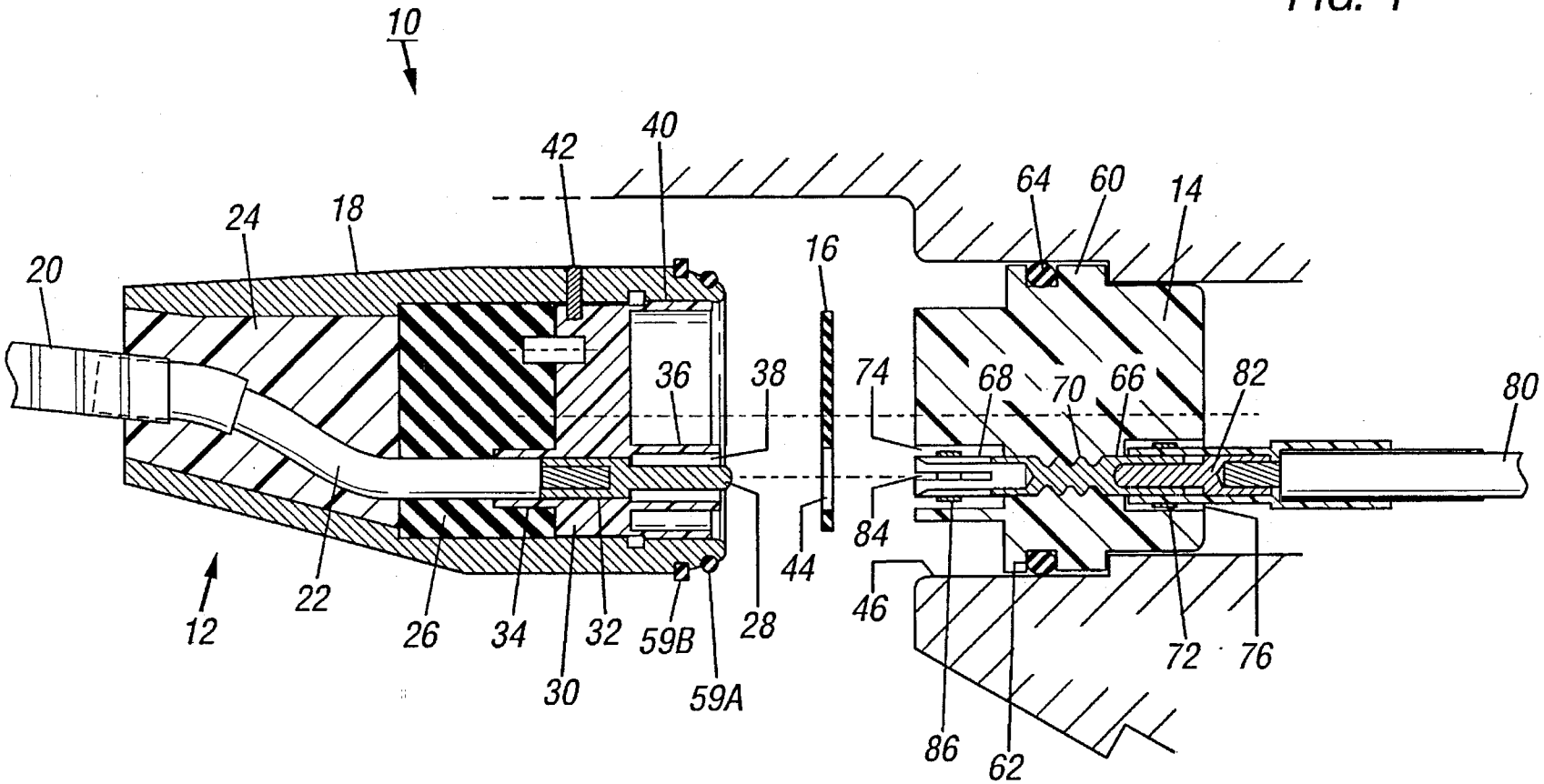
FIG. 1 is side elavational cross-sectional view of a submergible electric motor head with a plug-in pothead connector of one preferred embodiment of the present invention shown installed therein, and in connection to a cable that extends to a source of electrical power.
Figure 2:
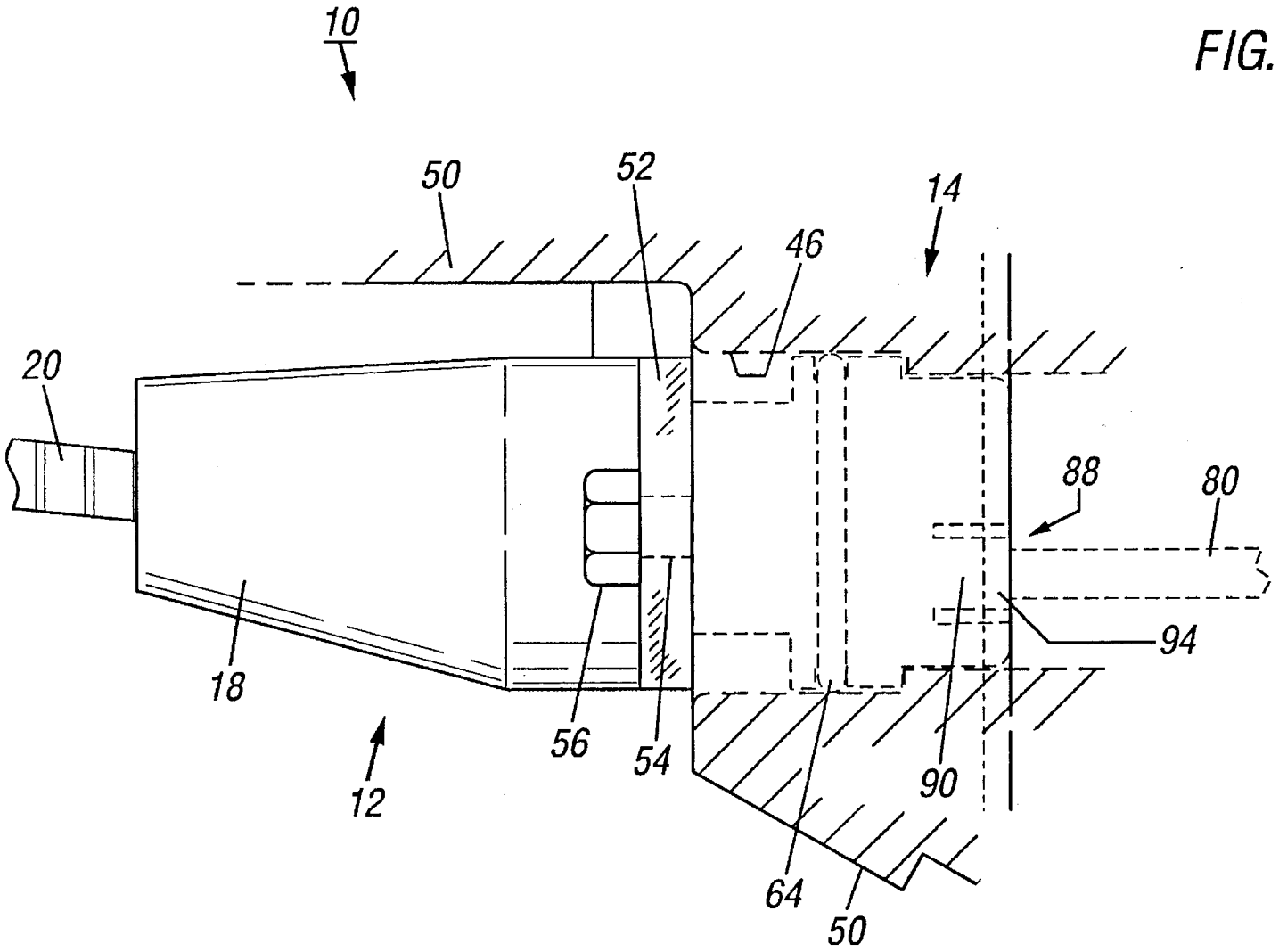
FIG. 2 is a side elevational view of a submergible electric motor head with a plug-in pothead connector of one preferred embodiment of the present invention shown installed therein, and in connection to a cable that extends to a source of electrical power.

As shown in FIGS. 1 and 2, a preferred embodiment of a plug-in pothead connector 10 of the present invention is generally comprised of three components: a pothead 12, a terminal block 14 and an elastomeric gasket 16. The individual components of the plug-in pothead connector will be described in particular relation for use within an electric submergible pumping system; however, it should be understood that the present invention can be used in any above-ground or wellbore application where a fluidically sealed electrical connection must be made that can resist temperatures up to 400 degrees F., and the presence of corrosive and hazardous fluids and gases, such as hydrogen sulfide.

The pothead 12 includes a metallic case of body 18 into which extends an armored electric cable 20 that extends to an electric power source (not shown). The cable 20 is comprised of at least two and generally three copper conductors 22 that enter the pothead body 18, pass through a body of sealing material 24, such as epoxy, and pass through a generally cylindrical body of elastomeric material 26, such as Aflas, Viton or nitrile rubber. The end of each conductor 22 includes a metallic electrical connector member 28, which is generally referred to as a terminal pin, which is soldered or press fitted thereon.

A molded front block 30 is inserted into the pothead body 18 adjacent the elastomeric material 26 and is adapted to interface with the terminal block 14, as will be described in detail below. The front block 30 is generally cylindrical in configuration with a plurality of holes 32 longitudinally passing therethrough. Coaxial annular back sleeves 34 surround the holes 32 and extending out from a rear side of the front block 30, and coaxial annular front sleeves 36 extend out from a front side of the front block 30. The conductors 22 extend into the back sleeves 34 and the terminal pins 28 extend to the front sleeves 36. The back sleeves 34 have an inside diameter slightly greater than the outside diameter of the conductors 22, and the diameter of the holes 32 is slightly greater than the outside diameter of the terminal pin 28. The inside diameter of the front sleeve 36 is greater than the outside diameter of the terminal pin 28 to create an annular space 38 therearound. The length of the front sleeves 36 and the longitudinal spacing of the terminal pins 28 therein are chosen so that the front sleeves 36 substantially surround the exposed metallic portion of the terminal pins 28, and the front sleeves 36 may extend out past the end of the terminal pins 28. In addition, the front face of the front block 30 includes an annular rim 40 which interacts with the terminal block 14 as will be described in detail below.

The front block 30 is radially and longitudinally aligned and secured within the pothead body 18 by way of adhesive material, longitudinal pins that extend into the elastomeric material 26, or at least one lateral pin 42 that extends through the side wall of the pothead body 18 and partially into a side surface of the front block 30. The front block 30 can be formed from any desired insulative material, and most preferably it is made from a high temperature thermoplastic material.

As used herein the term "high temperature thermoplastic material" means polymers stabilized or curable by heat, including polyetherketone (PEK), polyetheretherketone (PEEK), polyetherketoneetherketoneketone (PEKEKK), polyamides, polyethylene terephthalates (PET), polysulphones, epoxies, polyesters, polyethers, polyketones, and other polymerizable combinations thereof. For the purposes of the following discussion, the thermoplastic material will be assumed to be polyetheretherketone (PEEK).

The gasket 16 is a disk of elastomeric material with a plurality of holes 44 therethrough, with the holes' 44 diameter slightly greater than the outside diameter of the front sleeves 36. The gasket 16 is placed within the annular space formed by the annular rim 40 on the front block 30, and the front sleeves 36 extend out from the holes 44. The gasket 16 is formed from elastomeric material, such as Aflas, Viton or nitrile rubber, and is sized to form a fluidic seal against the rim 40 and the front sleeves 36 when the pothead body 18 is pressed against the terminal block 14, as will be described below.

Figure 3:
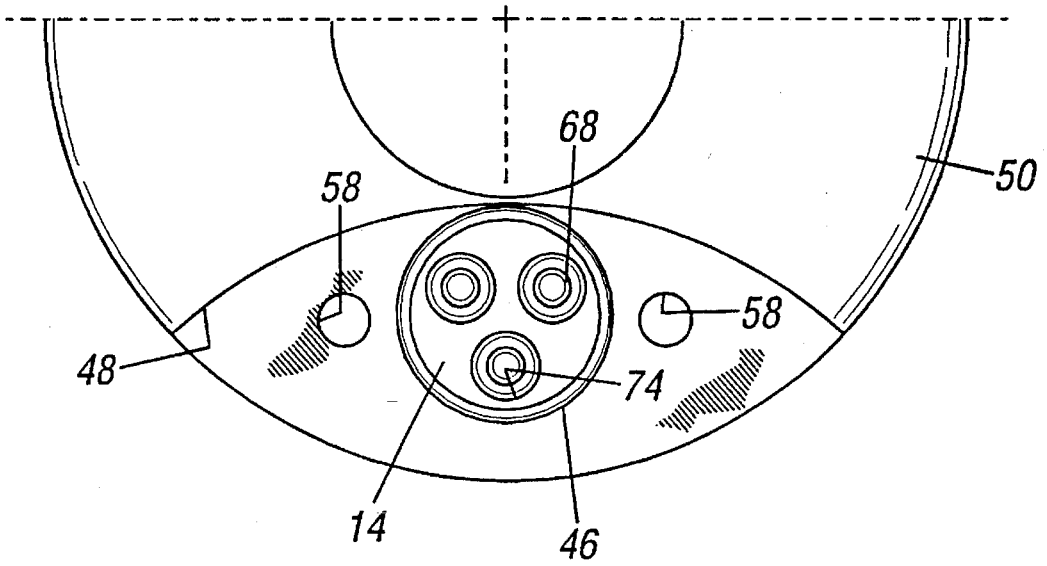
FIG. 3 is a plan view of motor head with one preferred embodiment of the plug-in pothead connector shown installed therein.
Figure 4:
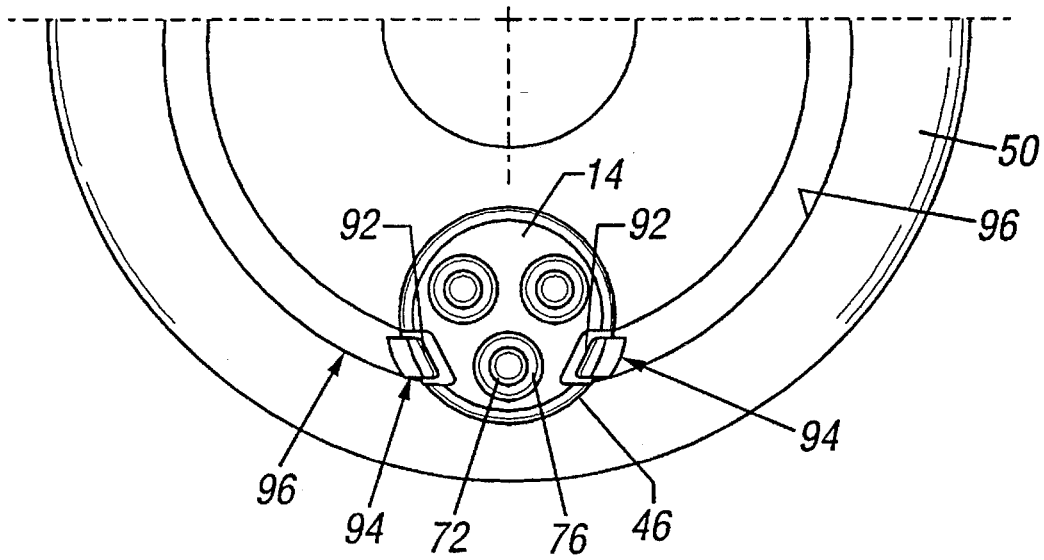
FIG. 4 is an underside view of a motor head with one preferred embodiment of the plug-in pothead connector shown installed therein.

As shown in FIGS. 1 and 2, the terminal block 14 is mounted within a bore 46 in an arcuate recess 48 in an upper portion of a motor head 50, which in turn is threaded onto an end of a submergible electric motor (not shown), as is well known to those skilled in the art. The pothead body 18 includes a mounting flange 52 adjacent the front face thereof and includes at least one and preferably two holes 54 therethrough. As shown in FIGS. 2 and 3, bolts 56 are inserted through the holes 54 and are threaded into threaded holes 58 in the motor head 50 to securely connect the pothead 12 to the terminal block 14 and to the motor head 50. An additional fluidic seal is provided by an annular O-ring 59A and a gasket 59B, both formed from elastomeric material, are mounted within respective recesses and edges on a front portion of the pothead body 18, so that when this front portion is pressed against the terminal block 14, the O-ring 59A and the gasket 59B form a fluidic seal within the bore 46. The terminal block 14 is generally cylindrical in configuration with an annular shoulder 60 therearound. The terminal block 14 is formed from any suitable insulative material, but it is preferably formed from a high temperature thermoplastic material, as described above. A recess or channel 62 is formed within the shoulder 60 and an O-ring seal 64 is mounted within the recess 62. The O-ring seal 64 seals against an inner wall of the bore 46 in the motor head 50 to further form a fluidic seal to prevent fluids from entering the interior of the electric motor through the bore 46. The terminal block 14 includes a plurality of metallic terminals 66 which are molded into the body of the terminal block 14. The molded-in terminals 66 eliminate a leakage path associated with prior terminals that used screw-in terminals. Each terminal 66 includes a metallic front cylinder 68, a mid portion 70 with ridges to prevent the terminal from being retracted from the terminal block 14, and a rear cylinder 72. The terminal block 14 includes front annular recesses 74 within which the front cylinders 68 reside, and includes coaxial rear annular recesses 76 within which the rear cylinders 72 reside. The front face of the terminal block 14 is substantially planar but it includes annular lips or rims 78 around each front recess 74.

As described above and as is shown in the attached drawings, the pothead 12 includes pin or "male" connectors and the terminal block 14 includes corresponding cylinder or "female" connectors. However, it should be understood that the pothead 12 can include cylinder connectors and the terminal block 14 can include pin connectors. In addition, other cooperative electrical connectors that operate by placing one component into contact with a corresponding component, such as spring, clips, end-to-end connectors and the like, can be utilized within the present invention. Motor lead wires 80 extend from the electric motor and each terminates with a metallic pin 82 that is inserted into the rear cylinder 72 of the terminals 66. The front cylinders 68 and the rear cylinders 72 each have longitudinal slots or cuts 84 with annular retaining spring clips or rings 86 around each cylinder 68 and 72. The cuts 84 and rings 86 assist in ensuring the integrity of the electrical connection made when a pin is inserted into each cylinder 68 and 72.

The rear portion of the terminal block 14 includes at least one and preferably two integrally formed spring clips 88. Each clip 88 includes a shank 90 formed by spaced parallel longitudinal cuts in the terminal block 14 and intersected by a transfer and connecting back cut 92. A beveled head 94 is formed on the end of the shanks 90 with the edge of the head 94 having a radial dimension greater than the radial dimension of the adjacent longitudinal side surface of the terminal block 14. The clips 88 are generally in-in and transverse to but do not intersect the longitudinal center axis of the terminal block 14.

When the terminal block 14 is inserted into the bore 46 in the motor head 50, the beveled heads 94 of the clips 88 are slightly compressed, and are able to expand when released at an annular groove 96 formed in the underside of the motor head 50. The beveled heads 94 are received into the groove 96 to radially and longitudinally align and secure the terminal block 14 within the motor head 50.

When an electrical connection is to be made between the cable 20 and the motor leads 80, the following assembly operation takes place. The motor leads 80, and specifically the pins 82, are inserted into the rear cylinders 72 of the terminals 66 and are secured therein by the compressive interaction of the rings 86 acting on the cuts 84. Additional insulative sleeves may be added to cover the rear cylinders 72 and the motor leads 80. The O-ring seal 64 is placed around the terminal block 14, and the terminal block 14 is then placed within the bore 46 in the motor head 50. The beveled heads 94 on the clips 88 prevent the terminal block 14 from being misaligned in that the terminal block 14 is rotated within the bore 46 until the beveled heads 94 expand into the groove 96, to thereby radially align the terminal block 14 and to prevent it from being removed from the motor head 50. The gasket 16 is placed against the front surface of the front block 30 within the rim 40, and the pothead 12 is pushed against the terminal block 14. The front sleeves 36 on the front block 30 are received into the front recesses 74 in the terminal block 14, and the pins 28 are inserted into the front cylinders 68 and are secured therein by the compressive interaction of the rings 86 acting on the cuts 84. The bolts 56 are inserted through the holes 54 in then are threaded into the holes 58 to force the front block 30 and the gasket 16 against the terminal block 14 and the motor head 50, and to compress the O-ring 59A and the gasket 59B into sealing engagement with the bore 46.

The superior fluidic sealing provided by the configuration of the preferred embodiments of the plug-in pothead connectors of the present invention can be attributed to one or more of the following component interactions described in relation to the following fluidic paths. If water was to enter the cable 20, the water would be prevented from shorting out of the pothead connector 10 by way of the compression of the epoxy 24 and the elastomeric material 26 about the conductors 22. If water was to enter the bore 46 in the motor head 50, the O-ring seal 64 would prevent any shorting out of the lead wires 80.

The most common fluidic pathway that leads to shorting out is across the interface of the pothead and the terminal block. However, in the present invention this shorting out is prevented by the front lip of the pothead body 18 fitting in close relation to the bore 46 in the motor head 50 and resting against the annular shoulder 60. The gasket 16 is compressed into sealing engagement against the rim 40, the front face of the front block 30, and the front sleeves 36, as well as being compressed into sealing engagement against the front face of the terminal block 14 and the annular rims 78 about the front recesses 74.

In addition to the sealing actions noted above, a circuitous arc path is formed by the size and configuration of the rim 40, the front sleeves 36, and the front recesses 74. Specifically, in the prior plug-in type connectors, if fluid was able to pass the typical interface gasket the water could directly contact the terminals. However, in order for water to short out the present invention water must: (a) pass the front lip of the pothead body 18 in close contact with the motor head's bore 46, pass the compressed O-ring 59A and gasket 59B, and the longitudinal side surface of the terminal block 14, (b) pass across the gasket 16 compressed against the rims 78 and the interface of the front block 30 and the terminal block 14, and most importantly (c) pass into and around the front sleeve 36 snugly fitted into the front recess 74.

As can be understood from the above discussion, the present invention provides a plug-in pothead connector with a superior circuitous arc path and a superior fluidic seal, over the prior connectors, as well as a simple and inexpensive configuration to ensure that the pothead and the terminal block are radially and longitudinally aligned and secured.

Whereas the present invention has been described in relation to the drawings attached hereto, it should be understood that other and further modifications, apart from those shown or suggested herein, may be made within the scope and spirit of the present invention.

What is claimed is:

1. An electrical connector for use with an electrical submergible pumping system, comprising:

a pothead having a first electrical connector member surrounded by a coaxial and spaced sleeve of insulative material extending from the pothead;

a terminal block with a recess therein adapted to receive there into the sleeve on the pothead and with a second electrical connector member set within the recess, the sleeve and the recess configured and sized to form a circuitous arc path, and the second electrical connector member adapted to form an electrical connection with the first electrical connector member; and means to fluidically seal an interface formed when the pothead is operatively connected to the terminal block.

2. An electrical connector of claim 1 wherein the pothead further comprises a body having an electrical cable extending into a first side thereof and each conductor within the cable terminating with one of the first electrical connector members, and including means for securing the pothead body to a motor head of an electric motor used within the electric submergible pumping system.

3. An electrical connector of claim 2 and further comprising a front block formed from an insulative material set within the pothead body, with each sleeve extending from the front block, and with at least one cable conductor extending into a first side of the front block and terminating with at least one first electrical connector member extending from the terminal block.

4. An electrical connector of claim 1 wherein the first electrical conductor member comprises a metallic pin, and the second electrical conductor member comprises a metallic cylinder.

5. An electrical connector of claim 1 wherein the terminal block further comprises a cylinder body formed from an insulative material with a lead wire connected to each of the second electrical connector members.

6. An electrical connector of claim 5 wherein at least one of the lead wires is connected to a metallic terminal molded into the cylinder body, and at least one of the second electrical connector members connected to the metallic terminal.

7. An electrical connector of claim 5 wherein the terminal block adapted to be received within a bore within a motor head of an electric motor used within the electric submergible pumping system.

8. An electrical connector of claim 7 wherein the terminal block includes means for securing the cylinder body to the motor head.

9. An electrical connector of claim 8 wherein the means for securing comprises at least one clip formed within the cylinder body, and adapted to cooperate within an annular recess within the motor head.

10. An electrical connector of claim 9 wherein the means for securing radially and longitudinally secures the cylinder body to the motor head.

11. An electrical connector of claim 5 and including an elastomeric seal mounted within an annular recess in the terminal block.

12. An electrical connector of claim 1 wherein the means to fluidically seal an interface formed when the pothead is operatively connected to the terminal block comprises an elastomeric gasket having at least one hole therein to receive a sleeve therethrough.

13. An electrical connector for use with an electrical submergible pumping system, comprising:

a terminal block having a first electrical connector member surrounded by a coaxial and spaced sleeve of insulative material extending from the terminal block;

a pot head with a recess therein adapted to receive there into the sleeve on the terminal block and with a second electrical connector member set within the recess, the sleeve and the recess configured and sized to form a circuitous arc path, and the second electrical connector member adapted to form an electrical connection with the first electrical connector member; and means to fluidically seal an interface formed when the pothead is operatively connected to the terminal block.

14. An electrical connector for use with an electrical submergible pumping system, comprising:

a pothead having a first electrical connector member surrounded by a sleeve of insulative material extending from the pothead;

a terminal block with a recess therein adapted to receive there into the sleeve on the pothead and with a second electrical connector member set within each of the recess, the sleeve and the recess configured and sized to form a circuitous arc path, and the second electrical connector member adapted to form an electrical connection with the first electrical connector member;

the terminal block comprises a cylinder body formed from an insulative material with a lead wire connected to the second electrical connector member, and adapted to be received within a bore within a motor head of an electric motor used within the electric submergible pumping system;

the terminal block including means for securing the cylinder body to the motor head, comprising at least one clip formed within the cylinder body and adapted to cooperate within an annular recess within the motor head; and means to fluidically seal an interface formed when the pothead is operatively connected to the terminal block.

15. An electrical connector of claim 14 wherein the at least one clip radially and longitudinally secures the cylinder body to the motor head.

* * * * *